US009974991B2

(12) United States Patent
Ernfjäll et al.

(10) Patent No.: US 9,974,991 B2
(45) Date of Patent: May 22, 2018

(54) FIRE DETECTION SYSTEM

(71) Applicant: Fogmaker International AB, Växjö (SE)

(72) Inventors: Johnny Ernfjäll, Lammhult (SE); Gustav Stigsohn, Norrhult (SE)

(73) Assignee: Fogmaker International AB, Växjö (SE)

( * ) Notice: Subject to any disclaimer, the term of this patent is extended or adjusted under 35 U.S.C. 154(b) by 158 days.

(21) Appl. No.: 14/435,055

(22) PCT Filed: Oct. 17, 2013

(86) PCT No.: PCT/EP2013/071703
§ 371 (c)(1),
(2) Date: Apr. 10, 2015

(87) PCT Pub. No.: WO2014/060506
PCT Pub. Date: Apr. 24, 2014

(65) Prior Publication Data

US 2015/0283415 A1 Oct. 8, 2015

(30) Foreign Application Priority Data

Oct. 17, 2012 (EP) ..... 12188871

(51) Int. Cl.
*A62C 37/00* (2006.01)
*A62C 37/44* (2006.01)
(Continued)

(52) U.S. Cl.
CPC ..... *A62C 37/44* (2013.01); *A62C 35/68* (2013.01); *A62C 37/46* (2013.01); *A62C 3/07* (2013.01)

(58) Field of Classification Search
CPC ..... A62C 37/44; A62C 37/46; A62C 37/48; A62C 37/50
(Continued)

(56) References Cited

U.S. PATENT DOCUMENTS 7,325,622 B2 * 2/2008 Sjostrom ..... A62C 3/07 169/29
2006/0021763 A1 * 2/2006 Golinveaux ..... A62C 35/60 169/17
(Continued)

FOREIGN PATENT DOCUMENTS

DE 10163527 C1 8/2003
GB 2115905 A 9/1983
WO WO 97/34659 A1 9/1997

OTHER PUBLICATIONS

International Search Report from PCT/EP2013/071703, dated Feb. 25, 2014, pp. 1-3.

*Primary Examiner* — Alexander Valvis
(74) *Attorney, Agent, or Firm* — Wolf, Greenfield & Sacks, P.C.

(57) ABSTRACT

The present invention relates to a fire detection system arranged for detecting fire by detecting a pressure drop in a detection conduit (15) caused by rupture of the detection conduit (15). The system comprises a detection fluid container (13) for holding a pressurized detection fluid, the detection conduit (15) which is connected to the detection fluid container (13), and a valve assembly controlling the supply of detection fluid from the detection fluid container (13) to the detection conduit (15). The valve assembly (17) is configured to assume: i) an open operating state, in which the valve assembly (17) permits fluid communication between the detection fluid container (13) and the detection conduit (15), wherein the valve assembly (17) comprises a holding member (41 *a*) upon which a pressure force exerted
(Continued)

by pressurized fluid in the detection conduit (15) acts to maintain the valve assembly (17) in the open operating position, and ii) a closed state, in which the valve assembly (17) prevents fluid communication between the detection fluid container (13) and the detection conduit (15), wherein the valve assembly (17) is arranged for switching from the open operating state to the closed state upon a reduction of the pressure force exerted on the holding member (41 *a*) caused by said pressure drop in the detection conduit (15), such that outflow of detection fluid is stopped. The present invention also relates to a method of controlling such as fire detection system.

16 Claims, 11 Drawing Sheets

(51) Int. Cl.

| | |
|---|---|
| ***A62C 37/46*** | (2006.01) |
| ***A62C 35/68*** | (2006.01) |
| *A62C 3/07* | (2006.01) |

(58) Field of Classification Search
USPC ..... 169/20, 85–88; 73/40 R, 40
See application file for complete search history.

(56) References Cited

U.S. PATENT DOCUMENTS

| | | | | |
|---|---|---|---|---|
| 2008/0277125 | A1* | 11/2008 | Wilkins | A62C 35/645 169/46 |
| 2010/0263882 | A1* | 10/2010 | Bodemann | A62C 35/62 169/17 |
| 2011/0011600 | A1* | 1/2011 | Eckholm | A62C 37/44 169/46 |
| 2011/0147016 | A1* | 6/2011 | Blease | A62C 35/68 169/17 |
| 2012/0292057 | A1* | 11/2012 | Schlatter | A62C 35/68 169/20 |

* cited by examiner

FIRE DETECTION SYSTEM

FIELD OF THE INVENTION

The present invention relates to a fire detection system arranged for detecting fire by detecting a pressure drop in a detection conduit caused by rupture of the detection conduit, the system comprising: a detection fluid container for holding a pressurized detection fluid, the detection conduit which is connected to the detection fluid container, and a valve assembly controlling the supply of detection fluid from the detection fluid container to the detection conduit.

The present invention also relates to a method of controlling such as fire detection system.

BACKGROUND OF THE INVENTION

A fire detection system of this type may e.g. be used in a fire extinguisher system for engine compartments. A detection hose is normally located in the upper part of the engine compartment and in the event of fire in the engine compartment the detection hose bursts due to heat generated by the fire. The fire detection system may be connected to an extinguisher system in order to activate the extinguisher system when a fire is detected. On activation of the extinguisher system extinguishing liquid is supplied to cool and extinguish the fire.

In the event of fire, detection fluid leaks due to rupture of the detection hose. Detection fluid used in fire detection systems of this type may be considered as being hazardous to the environment. It is therefore desired to keep the consumption of detection fluid as low as possible. A known fire detection system comprises a detection fluid cylinder which is connected to a detection hose by means of a tap. When the detection system is activated the tap is set in an open position. This detection system has the drawback that the consumption of detection fluid may be regarded as relatively high.

SUMMARY OF THE INVENTION

It is an object of the present invention to overcome the above described drawback, and to provide an improved fire detection system.

This and other objects that will be apparent from the following summary and description are achieved by a fire detection system according to the appended claims.

According to one aspect of the present disclosure there is provided a fire detection system arranged for detecting fire by detecting a pressure drop in a detection conduit caused by rupture of the detection conduit, the system comprising: a detection fluid container for holding a pressurized detection fluid, the detection conduit which is connected to the detection fluid container, and a valve assembly controlling the supply of detection fluid from the detection fluid container to the detection conduit, wherein the valve assembly is configured to assume: i) an open operating state, in which the valve assembly permits fluid communication between the detection fluid container and the detection conduit, wherein the valve assembly comprises a holding member upon which a pressure force exerted by pressurized fluid in the detection conduit acts to maintain the valve assembly in the open operating position, and ii) a closed state, in which the valve assembly prevents fluid communication between the detection fluid container and the detection conduit, wherein the valve assembly is arranged for switching from the open operating state to the closed state upon a reduction of the pressure force exerted on the holding member caused by said pressure drop in the detection conduit, such that outflow of detection fluid is stopped.

In the event of fire the detection conduit bursts due to heat generated by the fire. Consequently, detection fluid leaks from the detection system. This leakage causes a pressure drop in the detection conduit. In response to the pressure drop caused by leakage of detection fluid the valve assembly is switched from the open operating state to the closed state under the action of a pressure force exerted on the holding member by pressurized fluid in the detection fluid container. When the valve assembly is closed detection fluid cannot flow from the detection fluid container to the detection conduit. Hence, the detection fluid is preserved in the enclosed detection container. Detection fluid may be supplied from the detection fluid container when the valve assembly is reset to the open operating state, i.e. when the detection system is activated again. The remaining detection fluid and pressure in the enclosed space of the detection fluid container is thus preserved and can be used to fill up a replacement conduit. Hence, the detection system may be activated again without the need of refilling the detection fluid container. This has the advantage that the consumption of detection fluid, which may be considered as being harmful to the environment, may be reduced significantly. Hence, the environmental impact may be reduced significantly. The detection system is activated by switching the valve assembly from the closed state to the open operating state.

Furthermore, compensation of pressure differences between the detection conduit and the detection fluid container is enabled when the detection system is activated, i.e. when the valve assembly assumes the open operating state. Hence, the detection system may be used in a great variety of temperature conditions. Also, the detection fluid container may be located at a location which is separated from the location where a detection hose of the detection conduit is installed.

According to one embodiment the holding member is a plunger holding surface of a valve plunger of the valve assembly.

According to one embodiment the valve assembly comprises a resilient member which is arranged to exert a resilient force on the holding member, which resilient force co-operates with the pressure force to maintain the valve assembly in the open operating state. This embodiment has the advantage that the detection fluid container may be installed in any direction.

The resilient element is preferably a spring and more preferably a compression spring.

According to one embodiment the valve assembly comprises a valve actuator member for switching the valve assembly from the closed state to the open operating state.

In one embodiment the valve assembly comprises a holding member, a valve actuator member and a resilient element biased therebetween, wherein the resilient element acts to maintain the valve assembly in the open operating state.

According to one embodiment the valve assembly comprises a restricted flow path through which the detection fluid container communicates with the detection conduit when the valve assembly assumes the open operating state and which is blocked when the valve assembly is switched to the closed state.

Preferably, a valve plunger of the valve assembly comprises the restricted flow path.

Preferably, the valve assembly may assume an intermediate filling state, in which the opening for fluid communication between the detection fluid container and the detection conduit is larger than the opening for fluid communication between the detection fluid container and the detection conduit in the open operating state of the valve assembly. Hence in the intermediate filling state a larger flow from the detection fluid container to the detection conduit is allowed than in the open operating state.

According to one embodiment the detection conduit comprises a detection hose formed from a thermoplastic material, such as a thermoplastic fluoropolymer. This embodiment has the advantage that the detection conduit may resist relatively high temperatures which is advantageous in applications where the normal operating temperature is relatively high.

In one embodiment the detection system is configured for detection fluid in the form of detection liquid. In this embodiment the detection conduit does not need to be gas-tight. A liquid-tight detection hose, such as a detection hose formed from a liquid-tight polymeric material, may then be used. This embodiment has the advantage that the detection hose may withstand relatively high temperatures. Hence, such a detection system may be installed in environments where the operating temperature is relatively high, e.g. in an engine compartment. The liquid-tight detection conduit may be gas-permeable, which reduces requirements as regards tightness of the detection hose material and the valve assembly. Hence, a robust detection system may be provided in a very cost-efficient manner.

According to one embodiment a pressure indication device, such as a pressure switch, is fluidly connected to the detection fluid conduit. Then the actual pressure of the detection fluid in the detection conduit is monitored. This embodiment has the advantage that an alarm may be generated if the detection conduit is not filled with pressurized detection fluid during the installation of the detection system, which secures proper operation of the detection system after the installation thereof.

According to one embodiment the detection fluid container comprises a first chamber for detection fluid and a second chamber for drive gas, the first and second chambers being separated from each other by a piston displaceably arranged in the detection fluid container and sealed with regard to the inner wall of the detection container. This has the advantage that the detection fluid container may be arranged in any direction.

It is a further object of the present disclosure to provide an improved method of controlling a fire detection system.

This object is achieved by means of a method of controlling a fire detection system arranged for detecting fire by detecting a pressure drop in a detection conduit caused by rupture of the detection conduit, the system comprising: a detection fluid container for holding a pressurized detection fluid, the detection conduit which is connected to the detection fluid container, and a valve assembly controlling the supply of detection fluid from the detection fluid container to the detection conduit, the method comprising: the valve assembly, which comprises a holding member upon which a pressure force exerted by pressurized fluid in the detection conduit acts to maintain the valve assembly in an open operating state, switching, upon a reduction of the pressure force exerted on the holding member caused by said pressure drop in the detection conduit, from the open operating state, in which the valve assembly permits fluid communication between the detection fluid container and the detection conduit, to a closed state, in which the valve assembly prevents fluid communication between the detection fluid container and the detection conduit, thereby stopping outflow of detection fluid.

Further objects and features will be apparent from the description and the claims.

BRIEF DESCRIPTION OF THE DRAWINGS

The invention will now be described in more detail with reference to the appended drawings in which.

DESCRIPTION OF PREFERRED EMBODIMENTS

Figure 1:
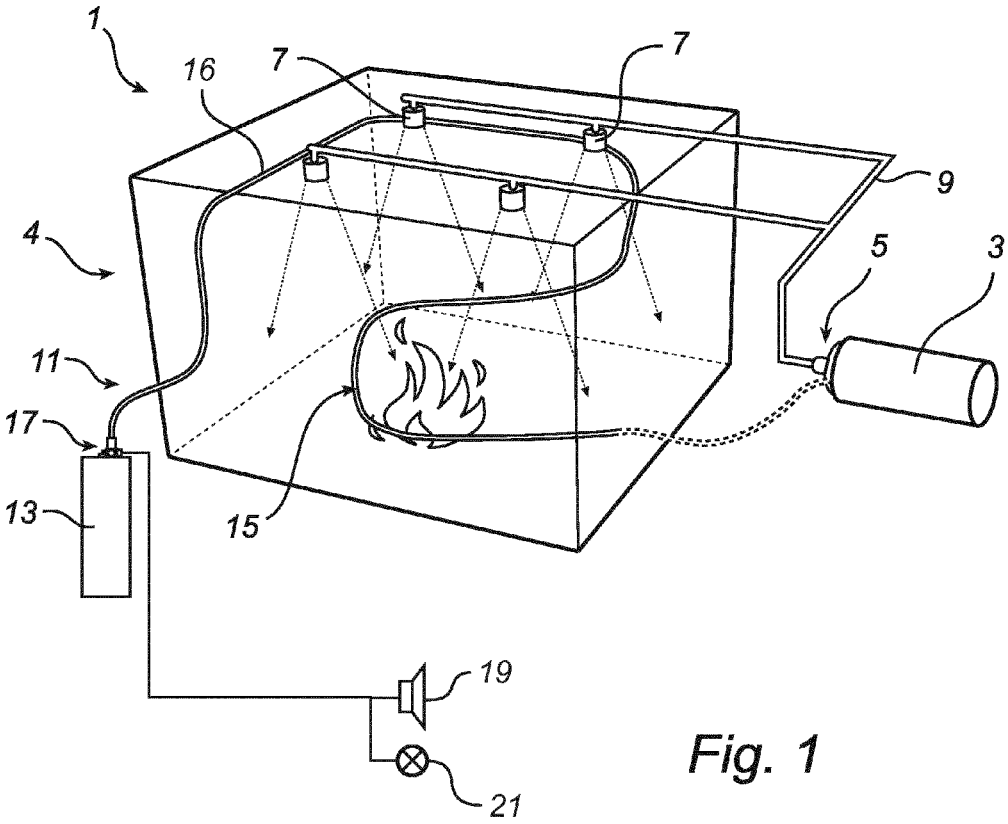
FIG. 1 is a schematic perspective view of a fire extinguisher system.
Figure 2:
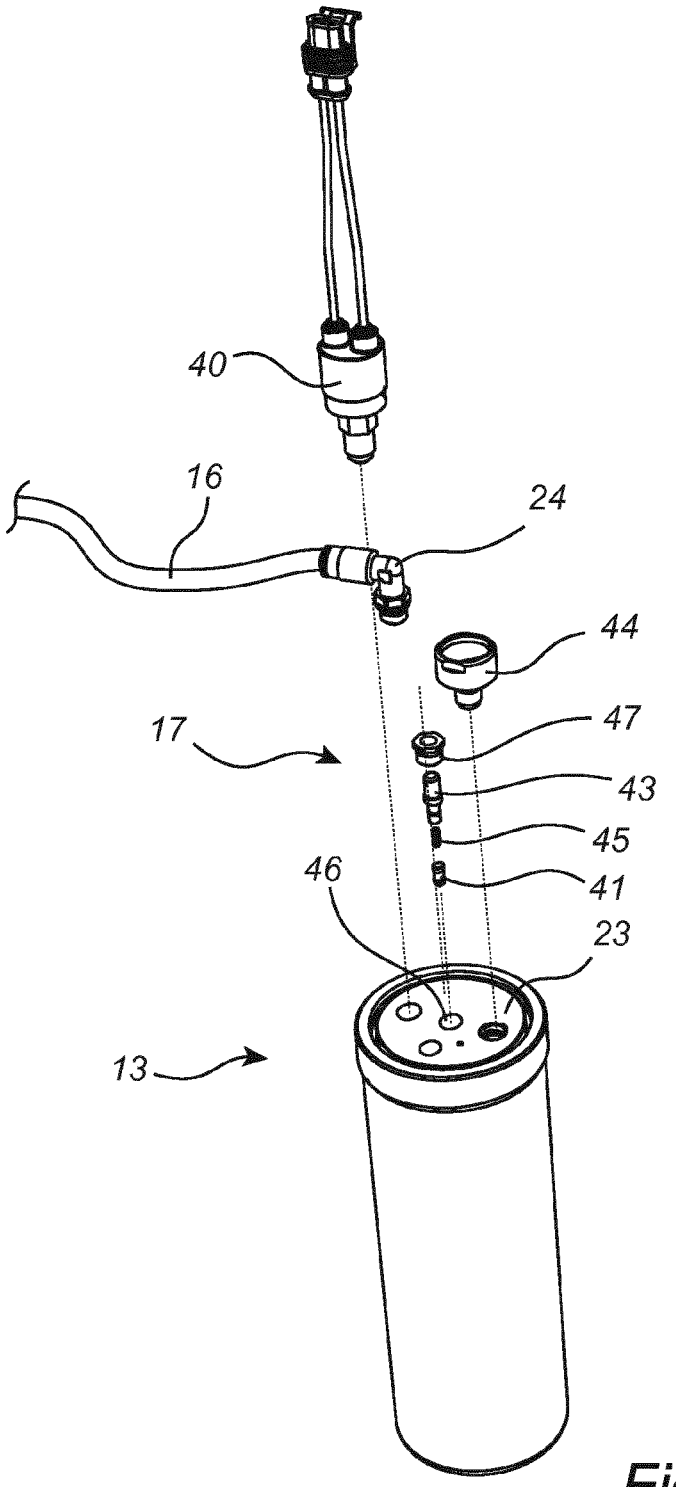
FIG. 2 shows, in an exploded view, a part of a fire detection system according to an embodiment of the present disclosure.

FIG. 1 illustrates a fire extinguisher system 1 for a compartment. The fire extinguisher system 1 may e.g. be installed in the engine compartment 4 of a vehicle (not shown), as schematically illustrated in FIG. 1. On activation of the extinguisher system 1 extinguishing liquid in the form of atomised mist is sprayed in the engine compartment 4 to cool and extinguish the fire.

The extinguisher system 1 comprises a pressure container 3 for extinguishing liquid, a release valve 5, several nozzles 7 which are connected to the release valve 5 by means of a piping system 9. The system 1 further comprises a fire detection system 11 according to the present disclosure which is connected to the release valve 5 of the extinguisher system 1. The detection system 11 is capable of detecting fire by detecting a pressure drop in a detection conduit 15 caused by rupture of a detection hose 16. When fire is detected by the detection system 11 the extinguisher system 1 is activated. On activation of the extinguisher system 1 the nozzles 7 are to spray the extinguishing liquid into the engine compartment 4, as schematically illustrated by the dashed arrows in FIG. 1.

The pressure container 3 is of a design known per se and forms two chambers, a first chamber for extinguishant liquid and a second chamber for a driving gas. The pressure container chambers are separated from each other by means of a piston displaceably arranged in the pressure container 3 and sealed with regard to the cylindrical wall by means of sealing rings. On delivery the extinguisher container 3 is filled with extinguishing fluid and drive gas to approximately 105 bars.

The detection system 11 comprises a detection fluid container 13 in the form of a liquid-tight detection fluid cylinder, a detection conduit 15 and a valve assembly 17 for controlling the supply of detection liquid to the detection hose 16. The detection hose 16 is connected to the detection fluid container 13 via the valve assembly 17. The valve assembly 17 controls the flow of detection liquid between the detection liquid container 13 and the detection conduit 15, as will be described in detail hereinafter with reference to FIGS. 4*a-d*.

The detection conduit 15 comprises a polymer detection hose 16. The detection hose 16 is connected to the release valve 5 of the extinguisher system 1, as illustrated in FIG. 1. In the event of fire in the engine compartment 4 the detection hose 16 bursts due to heat generated by the fire. Then, the pressure in the detection conduit 15 drops due to leakage of detection liquid from the detection hose 16. When the pressure in the detection conduit 15 has fallen to approximately 7 bar the release valve 5 on the pressure container 3 is activated and the extinguisher system 1 is released. Then, extinguishing liquid is sprayed into the engine compartment 4. The release valve 5 is of a design known per se.

As schematically illustrated in FIG. 1, a part of the detection conduit 15 is located in the upper part of the engine compartment 4. The pressure cylinder 3 with extinguishing liquid and the detection fluid container 13 with detection fluid are located in a separate area of the vehicle.

The detection system 11 further comprises an alarm lamp 19 and an alarm buzzer 21, which are activated in the event of fire in the engine compartment 4 or if the pressure in the detection system 11 falls below a predetermined level.

Referring to FIGS. 2, 3 and 4*a-d* the detection system 11 will be described in detail hereinafter.

Figure 3:
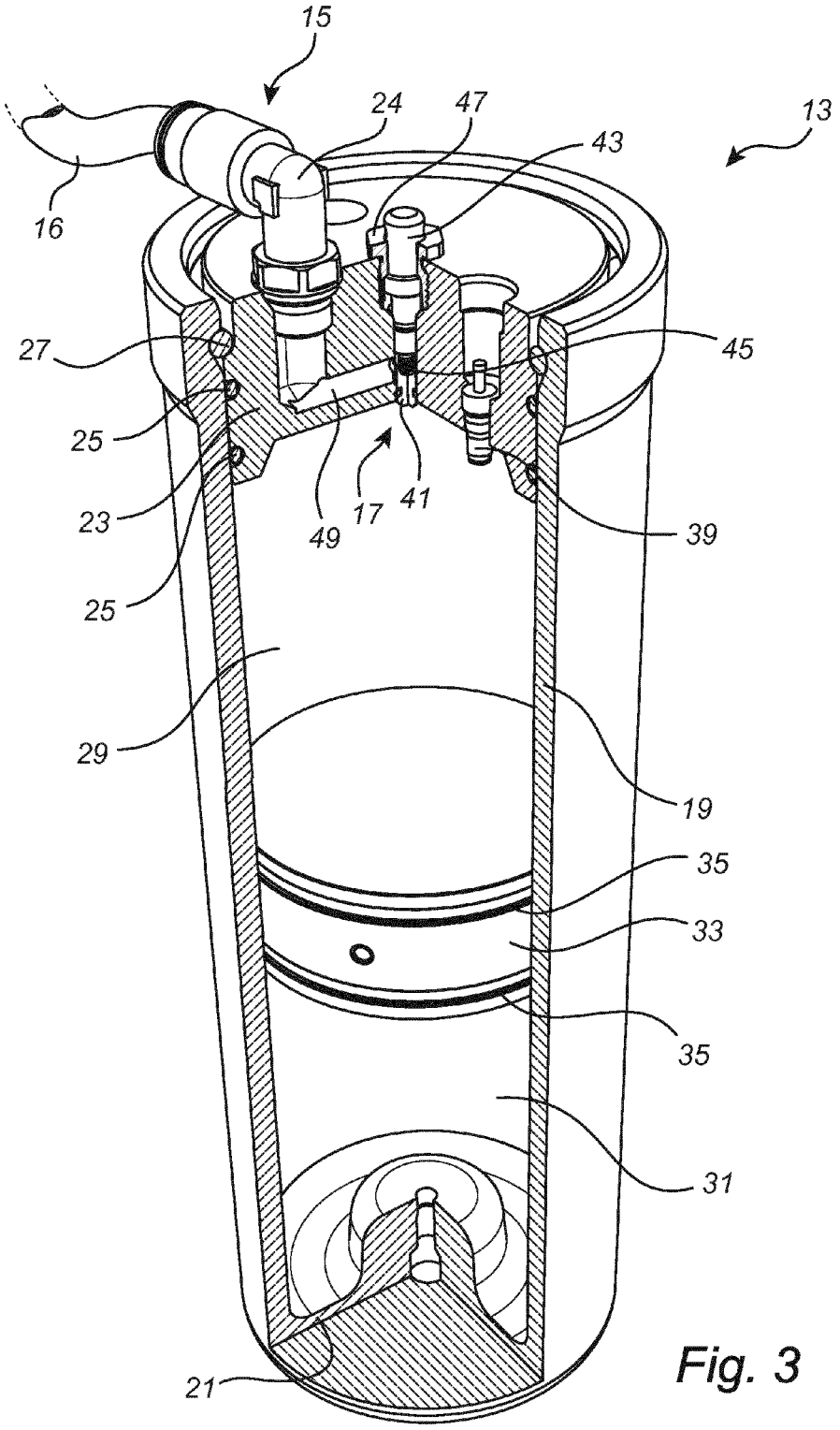
FIG. 3 shows, in a partially sectioned view, a detection fluid container of the fire detection system shown in FIG. 2.

The detection fluid container 13 comprises a cylindrical wall 19 having a fixed lower end wall 21 and an upper end wall 23 connected with the cylindrical wall 19 by means of a sealing rings 25 and a locking ring 27, as illustrated in FIG. 3. The detection liquid container 13 forms two chambers, a first chamber 29 for detection liquid and a second chamber 31 for a driving gas. The chambers 29, 31 are separated from each other by means of a piston 33 displaceably arranged in the detection liquid container 13 and sealed with regard to the cylindrical wall 19 by means of sealing rings 35. The lower end wall 21 is provided with a charging valve (not shown) for drive gas while the upper end wall 23 is provided with a charging valve 39 for detection liquid. In this embodiment detection fluid in the form of detection liquid is used. On delivery the first 29 and second chamber 31 of the detection liquid container 13 is filled with detection liquid, such as e.g. glycol-based anti-freeze and drive gas, such as nitrogen gas, respectively, to approximately 20-24 bar.

The upper end wall 23 of the detection liquid container 13 is provided with a pressure gauge 44 showing the actual pressure of the detection liquid in the first chamber 29 of the detection container 13. The upper end wall 23 is further provided with a pressure switch 40 which sends an alarm if the pressure in the detection conduit 15 falls below 14 bar. An L-shaped coupling element 24, to which the detection hose 16 is connected, is secured to the end wall 23. The end wall 23 has a discharge channel 49 to which the detection hose 16 is connected by means of the coupling element 24 and which forms a part of the detection conduit 15.

Figure 4A:
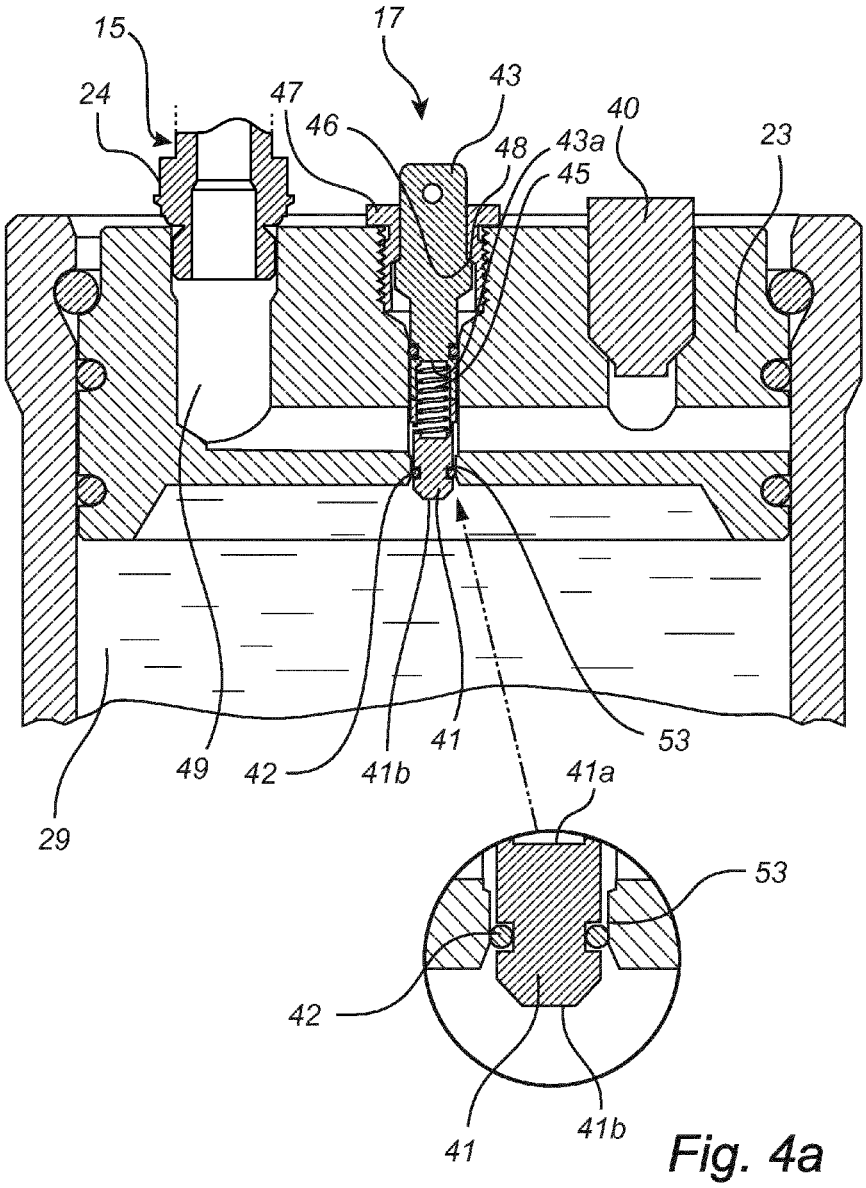
FIG. 4*a-d* illustrates the function of a fire detection system according to an embodiment of the present disclosure.

The valve assembly 17 comprises a valve plunger 41, a valve actuator member 43 and a resilient element in the form of a pressure spring 45 arranged therebetween. The valve plunger 41 has a first pressure surface 41*a* which forms a holding member in the form of a valve plunger holding surface. The valve plunger 41 has a second pressure surface 41*b* which forms a valve closing surface. The valve plunger 41 is disposed in an opening formed in the upper end wall 23 of the detection liquid container 13. The pressure spring 45 is arranged between the valve plunger 41 and the valve actuator member 43, as illustrated in FIG. 4*a*. A sleeve 47, which is secured to the upper end wall 23 of the detection liquid cylinder 13, defines an outer position of the valve actuator member 43.

FIG. 4*a* illustrates the valve assembly 17 in a closed state, in which the valve assembly 17 prevents fluid communication between the first chamber 29 of the detection fluid container 13 and the detection conduit 15. In the closed state the valve plunger 41 is pressed against a valve seat 53 by a force exerted on the plunger closing surface 41*b* by pressurized detection liquid stored in the first chamber 29 of the detection fluid cylinder 13. The valve plunger 41 is then in a closed position, in which it prevents fluid communication between the first chamber 29 of the detection liquid container 13 and the discharge channel 49 of the detection conduit 15. A sealing ring 42 is provided to secure the sealing function in the closed state. Prior to activation of the detection system 11 the detection fluid cylinder 13 may thus be maintained in a so called transport state, illustrated in FIG. 4*a*, which allow safe transport of the detection fluid cylinder 13. The fire detection system 11 may thus be transported to a desired location in a safe manner without risk of leakage of detection fluid. Furthermore, in the transport state the valve actuator member 43 is held in its outer position, illustrated in FIG. 4*a*, by a force exerted on the valve actuator member 43 by the pressure spring 45. In this outer position a part 46 of the valve actuator member 43 abuts against an inner stop surface 48 of the sleeve 47 which is secured to the upper end wall 23 of the detection liquid container 13.

Before activation of the detection system 11*a* detection hose 16 is connected to the discharge channel 49 via the L-shaped coupling element 24. Preferably, a detection hose 16 which is prefilled with detection fluid is connected to the coupling element 24. The detection hose 16 is adapted to burst when subjected to heat generated in the event of fire in the engine compartment 4. Preferably, a detection hose 16 that bursts when subjected to a temperature of about 175° C. is used. For instance, a detection hose formed from a polymeric material, such as ETFE, may be used.

Figure 4B:
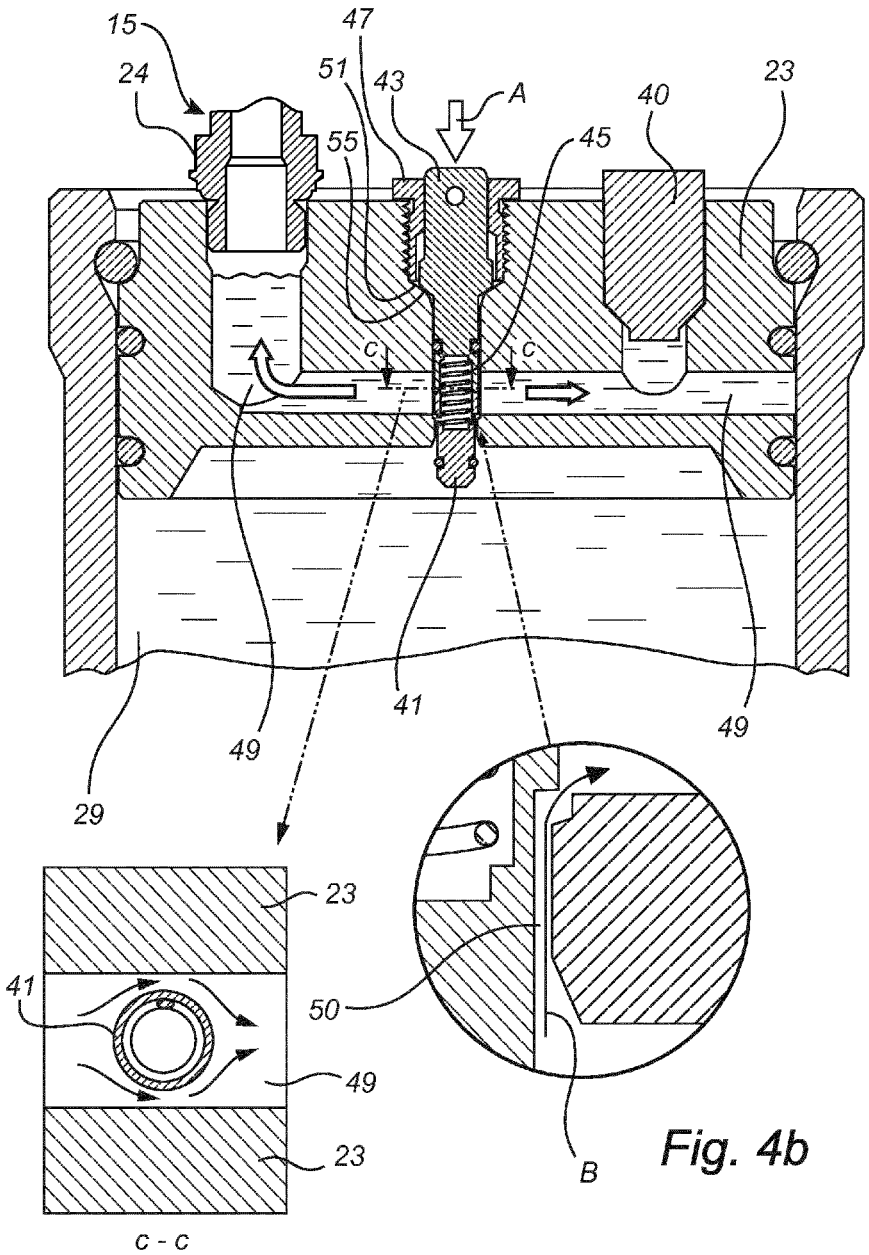

FIG. 4*b* illustrates activation of the detection system 11. Activation of the detection system is carried out by pressing the valve actuator member 43 towards the valve plunger 41, as illustrated by arrow A in FIG. 4*b*. As long as the valve actuator member 43 is depressed the valve assembly 17 assumes an intermediate filling position, illustrated in FIG. 4*b*. Then, fluid communication between the first chamber 29 and the discharge channel 49 is established and detection liquid is supplied to the discharge channel 49, as illustrated by arrow B in an enlarged part of FIG. 4*b*. In the intermediate filling state, pressurized detection liquid flows from the detection cylinder 13 to the discharge channel 49 and to the detection hose 16 which is fluidly connected to the discharge channel 49. Detection fluid flows through a narrow circumferential passage 50 formed between the valve closure member member and the end wall 23. The valve actuator member 43 is held in this position until the detection conduit 15, i.e. the discharge channel 49 and the detection hose 16, which is fluidly connected to the channel 49, is filled with detection liquid. In the intermediate filling state a part 51 of the valve actuator member 43 abuts against a stop surface 53 of the upper end wall 23. The stop surface 53 defines an inner position of the valve actuator member 43.

In order to fill up the detection conduit 15 the valve actuator member 43 typically needs to be depressed for a few seconds. If a prefilled detection hose is used only the discharge channel 49 and the interior flow channel of the coupling element 24 need to be filled. When the valve actuator member 43 is released from its depressed state, i.e. when the external force holding the valve actuator member 43 depressed is removed, the valve activation member 43 is moved outwards from its inner position to its outer position under the action of pressurized liquid in the discharge channel 49 acting on a pressure surface 43*a* of the valve actuator member 43 and a force from the pressure spring 45, as illustrated in FIG. 4*c*.

Figure 4C:
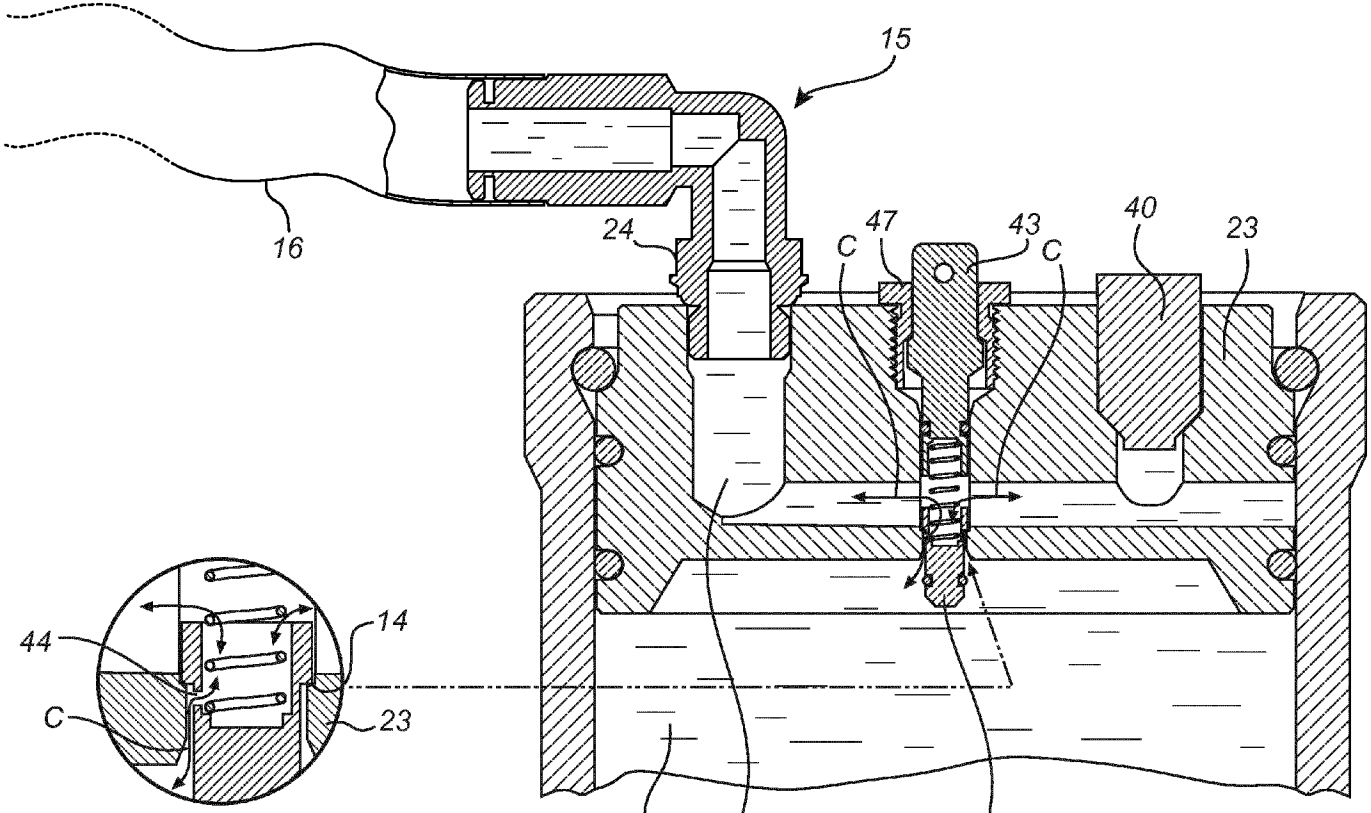

In FIG. 4*c* the detection system 11 is shown in an activated state. In the activated state the valve assembly 17 assumes an open operating state, in which the valve assembly 17 permits fluid communication between the detection fluid container 13 and the detection conduit 15. Then, a part 14 of the valve plunger 41 abuts against the upper end wall 23, as best illustrated in the enlarged part of FIG. 4*c*. The plunger holding surface 41*a* is in fluid contact with the detection fluid in the detection conduit 15. Hence, the pressurized detection fluid in the detection conduit 15 exerts a pressure force on the plunger holding surface 41*a*. Furthermore, the pressure spring 45 exerts a resilient force on the valve plunger 41. The pressure force exerted on the plunger holding surface 41*a* by the detection fluid in the detection conduit 15 co-operates with the resilient force from the spring 45 to maintain the valve assembly 17 in the open operating state. In this embodiment the valve plunger 41 comprises a restricted flow path in the form of an orifice 42 through which detection liquid may flow when the detection system 11 is activated. The orifice 44 thus defines a flow path which enables fluid communication between the discharge channel 49 and the first chamber 29 of the detection liquid container 13 in the open operating state of the valve assembly 17. In the open operating state detection fluid may thus pass the valve plunger 41 via the orifice 44, as illustrated by arrows C in FIG. 4*c*. Flow between the first chamber 29 and the discharge channel 49, and thus the detection hose 16, is thus allowed to compensate for temperature variations in the compartment 4 where the detection hose 16 is arranged. As mentioned above the detection liquid cylinder 13 may be located at a location which is separated from the compartment 4 where the detection hose 15 is installed. Then, the detection system 11 may be subjected to temperature variations that may cause pressure variations in the detection system 11. The orifice 44 compensates for such pressure variations since a limited flow between the first chamber 29 of the detection liquid cylinder 13 and the channel 49, to which the hose 16 is fluidly connected, is allowed in the open operating state. It should be noted that the difference between the pressure in the detection conduit 15 and the pressure in the detection liquid cylinder 13 caused by such temperature variations are very low compared to the pressure difference in the event of a rupture of the detection conduit 15.

In the event of fire in the engine compartment 4 the detection conduit 16 bursts due to heat generated by the fire. Consequently, detection liquid leaks from the detection hose 16, as illustrated by arrows D in FIG. 4*d*. Then, the pressure in the detection hose 16 drops. When the pressure in the detection liquid conduit 15 has fallen to a predetermined value the release valve 5 on the extinguisher liquid cylinder 3 is activated and the fire extinguisher system 1 is released. Then, extinguishing liquid is sprayed through nozzles 7 of the fire extinguisher system 1. Also, the pressure switch 40 in the end wall 23 of the detector container 13 sends an alarm to the driver position.

Leakage of detection fluid from the detection hose 16 causes a pressure drop in the detection fluid conduit 15 and across the valve plunger 41. Consequently, the pressure force exerted on the plunger holding member is reduced. The valve assembly 17 is arranged for switching from the open operating state to the closed state upon a reduction of the pressure force exerted on the holding member caused by the pressure drop in the detection conduit 15, such that outflow of detection fluid is stopped.

As soon as the pressure drop across the valve plunger 41 exceeds a certain value the valve plunger 41 is thus moved against the valve seat 53 by a pressure force exerted to the plunger closing surface 41*b* by pressurised liquid in the first chamber 29 of the detection liquid cylinder 13. Then the pressure force exerted on the plunger closing surface 41*b* by pressurized fluid in the detection fluid container 13 thus exceeds the force exerted on the plunger holding surface 41*a* by fluid in the detection conduit 15 and by the pressure spring 45. It is noted that the pressure difference needed to effect closing of the valve closure member 44 against the valve seat 53 is significantly larger than pressure differences that may arise due to temperature variations that the detection system 11 may be subjected to during normal operating conditions. Typically, a pressure difference of at least a few bars is required to effect switching of the valve assembly from the open operating state to the closed state.

Figure 4D:
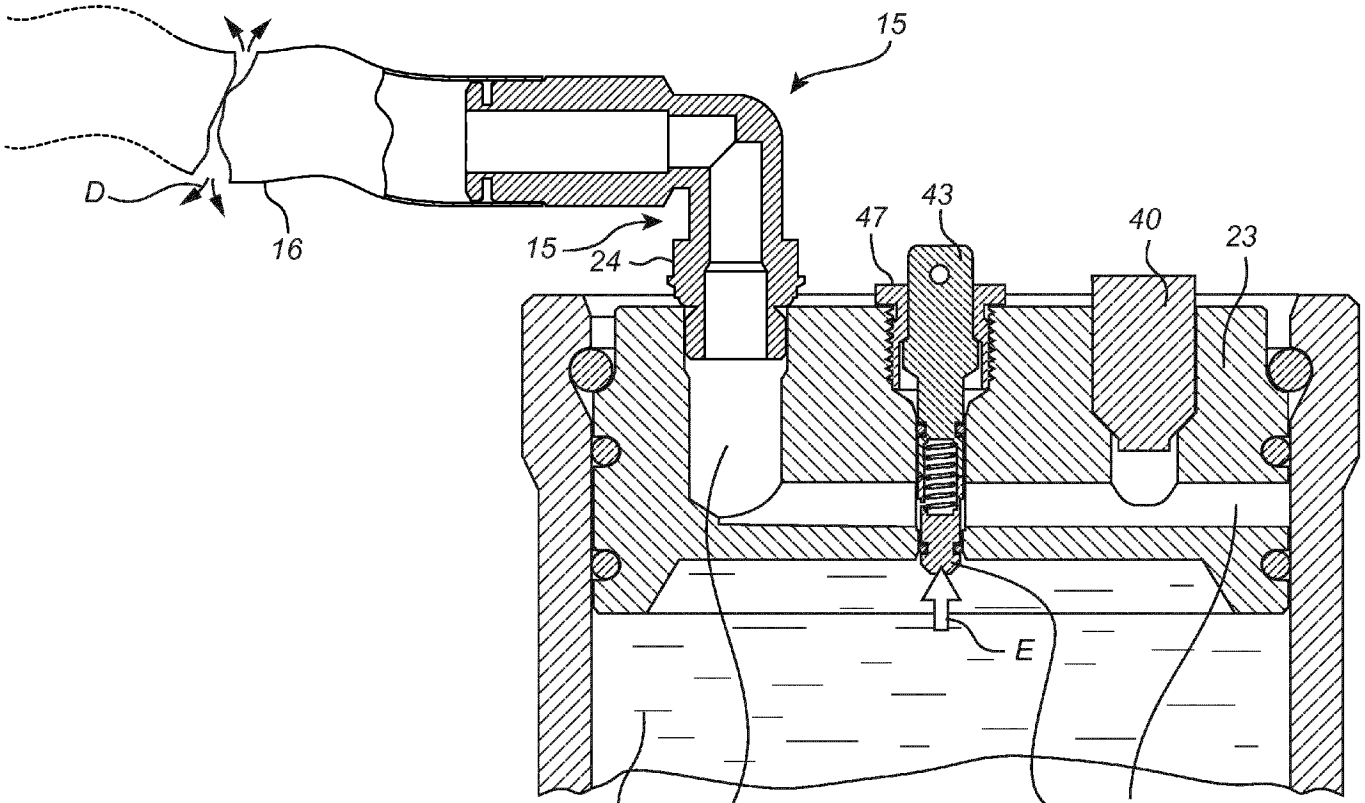

Hence, in response to a relatively large pressure difference between the discharge channel 49 and the first chamber 29 of the detection liquid container 13 the valve plunger 41 is thus moved to the closed position against the valve seat 53 under the action of a force exerted on the plunger closing surface 41*b* by pressurized liquid in the detection liquid container 13, as illustrated by arrow E in FIG. 4*d*. Fluid communication between the first chamber 29 of the detection liquid container 13 and the discharge channel 49 is then prevented. Hence, the remaining pressurized detection liquid in the detection liquid container 13 is preserved and can be used to fill up a replacement detection hose.

Also, when the pressure in the discharge channel 49 falls below approximately 14 bar, the pressure switch 40 sends an alarm signal to the alarm lamp 19 as well as to the buzzer 2.

Hereinafter a fire detection system according to a second embodiment will be described with reference to FIGS. 5*a-d*. Many features disclosed in the first embodiment are also present in the second embodiment with similar reference numerals identifying similar or same features. Having mentioned this, the description will focus on explaining the differing features of the second embodiment.

Figure 5A:
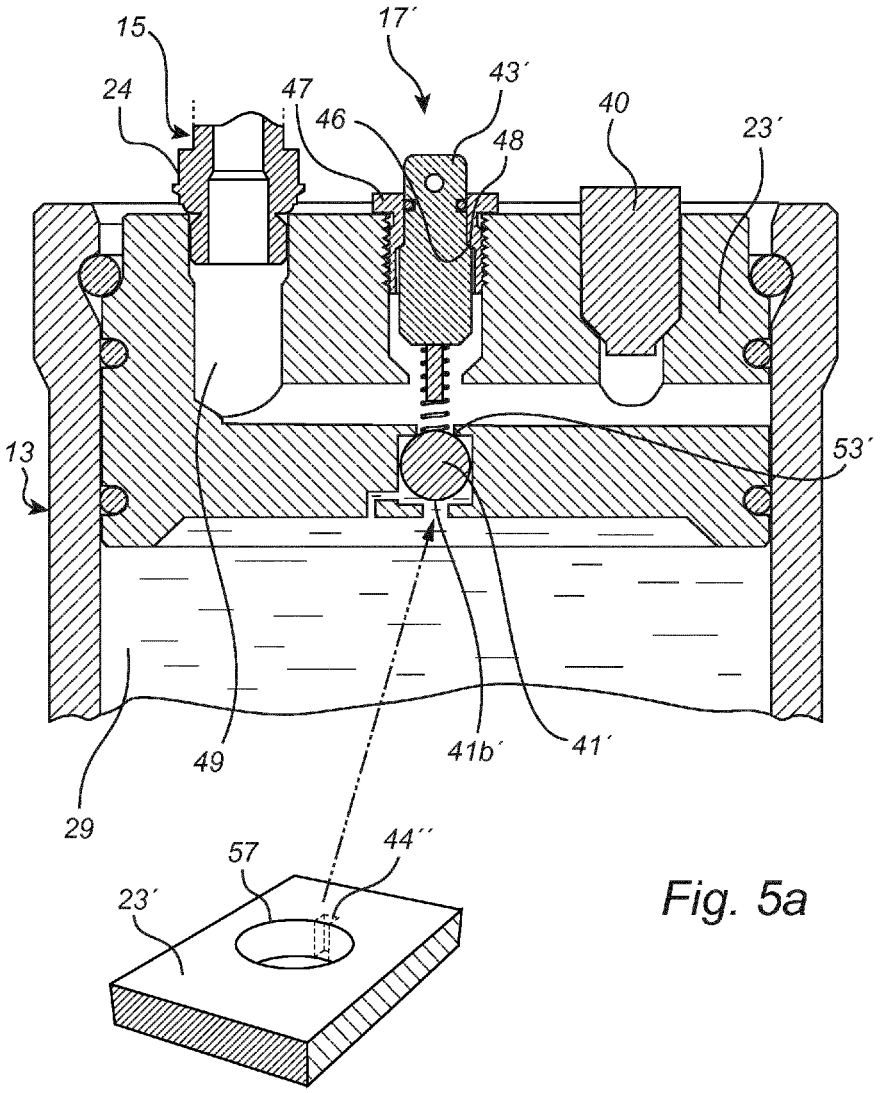
FIG. 5*a-d* illustrates a fire detection system according to a second embodiment of the present disclosure.

FIG. 5*a* illustrates the valve assembly 17' of the fire detection system in a closed state, in which the valve assembly 17' prevents fluid communication between the first chamber 29 of the detection fluid container 13 and the detection conduit 15. In the closed state the valve plunger, in this embodiment a ball 41' instead of a piston, is pressed against an upper valve seat 53' by a force exerted on the plunger closing surface 41*b'* by pressurized detection liquid stored in the first chamber 29 of the detection fluid cylinder 13. The valve plunger 41' is then in a closed position, in which it prevents fluid communication between the first chamber 29 of the detection liquid container 13 and the discharge channel 49 of the detection conduit 15.

Figure 5B:
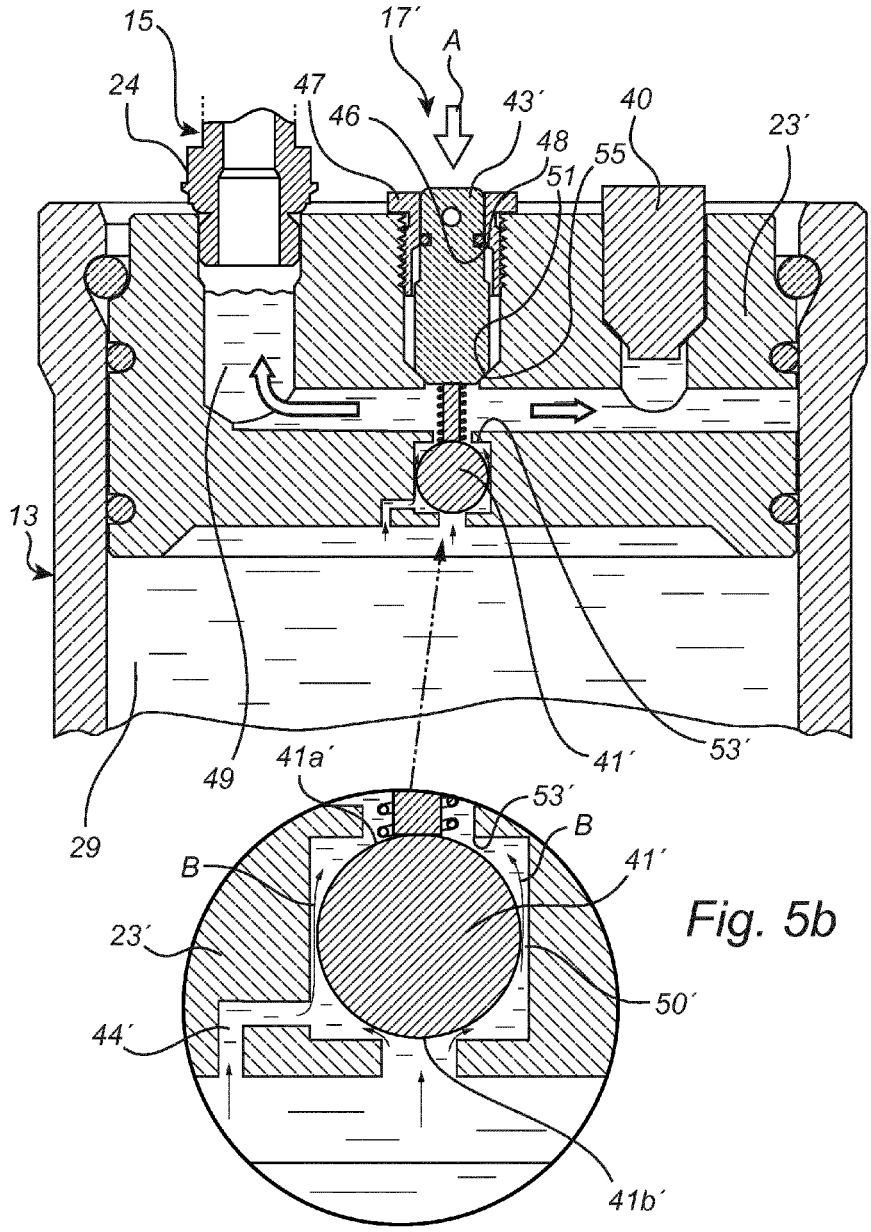

FIG. 5*b* illustrates activation of the detection system. Activation is carried out by pressing the valve actuator member 43' towards the valve plunger 41', as illustrated by arrow A in FIG. 5*b*. As long as the valve actuator member 43' is depressed the valve assembly 17' assumes an intermediate filling position, illustrated in FIG. 5*b*. Then, fluid communication between the first chamber 29 and the discharge channel 49 is established and detection liquid is supplied to the discharge channel 49, as illustrated by arrows B in an enlarged part of FIG. 5*b*. In the intermediate filling state, pressurized detection liquid flows from the first chamber 29 of the detection cylinder 13 to the discharge channel 49 and to the detection hose 16 which is fluidly connected to the discharge channel 49. Detection fluid flows through a narrow circumferential passage 50', illustrated in the enlarged part of FIG. 5*b*, formed between the value closure member and the upper end wall 23'. The valve actuator member 43' is held in this position until the detection conduit 15, i.e. the discharge channel 49 and the detection hose 16, which is fluidly connected to the channel 49, is filled with detection liquid.

Figure 5C:
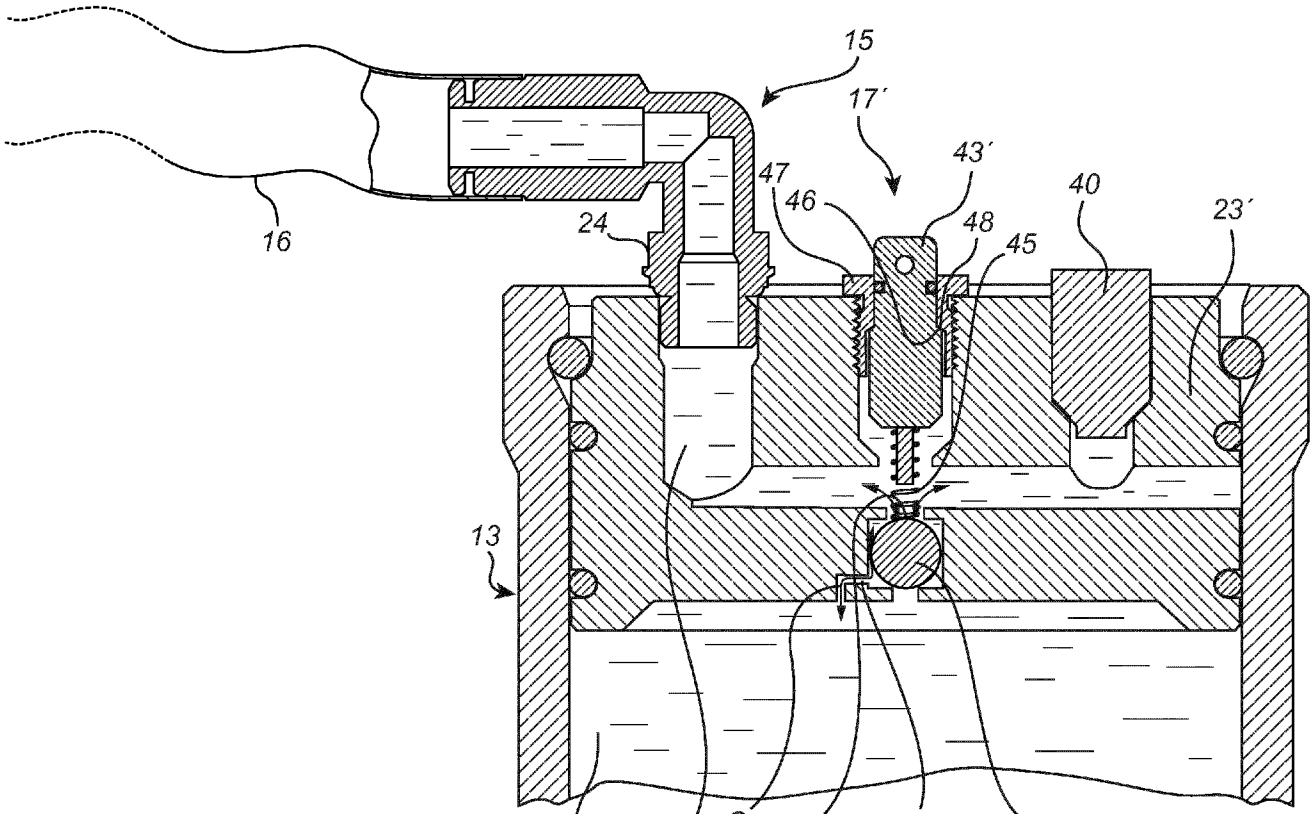

In FIG. 5*c* the detection system is shown in an activated state. In the activated state the valve assembly 17' assumes an open operating state, in which the valve assembly 17' permits fluid communication between the first chamber 29 of the detection fluid container 13 and the detection conduit 15. The plunger holding surface 41*a'* is in fluid contact with the detection fluid in the detection conduit 15. Hence, the pressurized detection fluid in the detection conduit 15 exerts a pressure force on the plunger holding surface 41*a'*. Furthermore, the pressure spring 45 exerts a resilient force on the valve plunger 41'. The pressure force exerted on the plunger holding surface 41*a'* by the detection fluid in the detection conduit 15 co-operates with the resilient force from the spring 45 to maintain the valve assembly 17' in the open operating state. In this embodiment the upper end wall 23' comprises a channel 44', as best illustrated in the enlarged part of FIG. 5*b*, through which detection liquid may flow when the detection system is activated. The channel 44' thus defines a flow path which enables fluid communication between the discharge channel 49 and the first chamber 29 of the detection liquid container 13 in the open operating state of the valve assembly 17'. In the open operating state detection fluid may thus pass the valve plunger 41' via the channel 44', as illustrated by arrow C in FIG. 5*c*. Flow between the first chamber 29 and the discharge channel 49, and thus the detection hose 16, is thus allowed to compensate for temperature variations in the compartment where the detection hose 16 is arranged. As an alternative or complement to the channel 44', the upper end wall 23' may be provided with a groove 44" at a lower valve seat 57, as illustrated in FIG. 5*a*, which groove 44" forms a fluid passage through which fluid may pass in the activated state, i.e. the state illustrated in FIG. 5*c*.

Figure 5D:
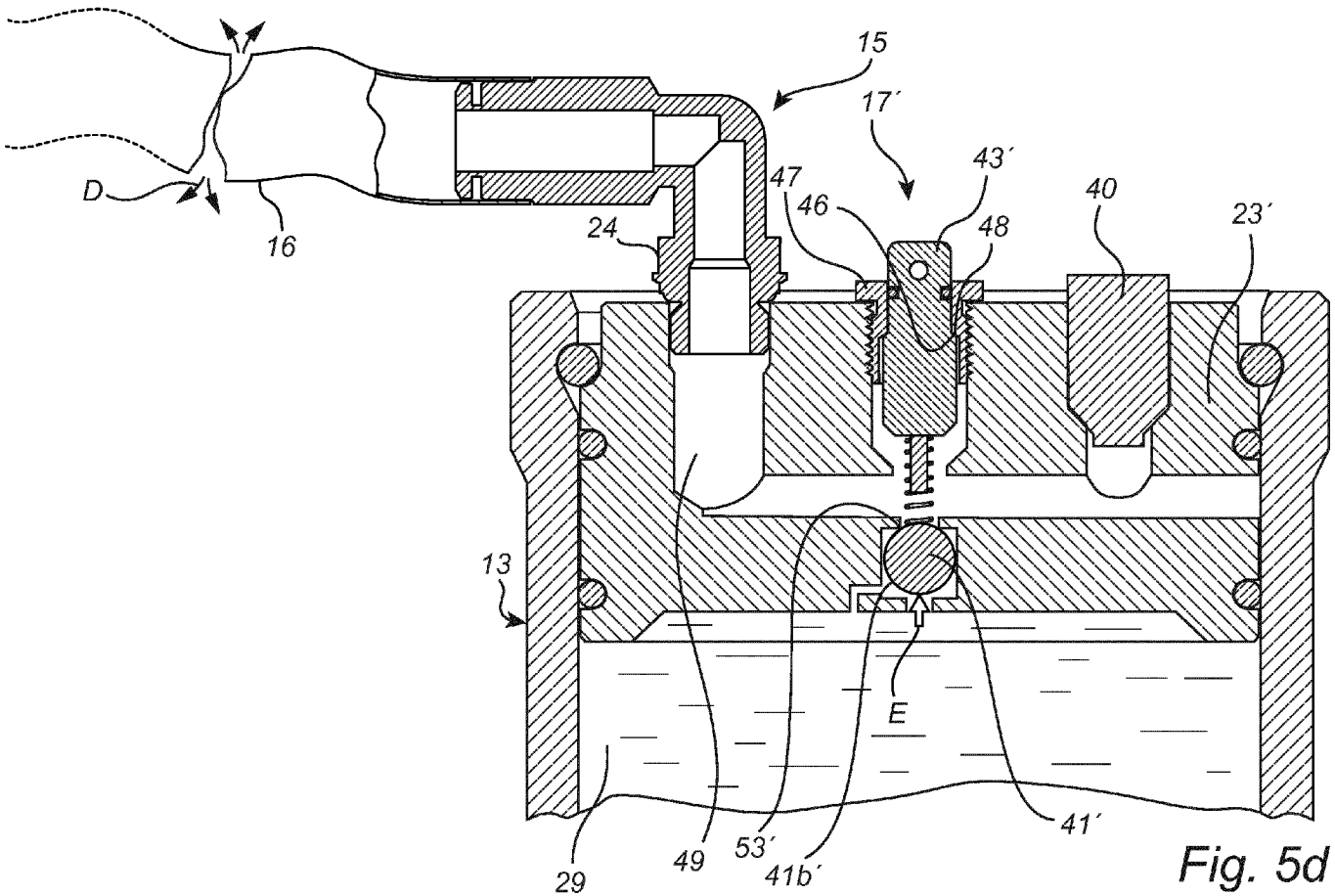

FIG. 5*d* illustrates the valve assembly 17' in a closed state. In this state the valve plunger 41' is pressed against the upper valve seat 53' by a force exerted on a plunger closing surface 41*b'* by pressurized liquid in the first chamber 29 of the detection liquid container 13, as illustrated by arrow E. Fluid communication between the first chamber 29 of the detection liquid container 13 and the discharge channel 49 is then prevented by the valve plunger 41'.

In this embodiment the valve plunger is thus a ball, while in the first embodiment the valve plunger is a piston. It is appreciated that the valve plunger may have another shape, such as, e.g., the shape of a cone.

It will be appreciated that numerous variants of the embodiments described above are possible within the scope of the appended claims.

Hereinbefore it has been shown that a detection system may be connected to a fire extinguisher system, as illustrated by the dashed part of the detection hose 16 in FIG. 1. It is however realised that a detection system according to the present disclosure may be used for solely detecting a fire, i.e. as a separate detection system not coupled to a fire extinguisher system.

Hereinbefore is has been described that detection fluid in the form of detection liquid may be used. It is however realised that detection fluid in the form of detection gas, such as e.g. nitrogen, may be used instead of detection liquid. Then, the detection conduit is preferably gas-tight. For instance, a gas-tight detection hose formed from polyamide may be used.

The invention claimed is:

1. Fire detection system arranged for detecting fire by detecting a pressure drop in a detection conduit (15) caused by rupture of the detection conduit (15), the system comprising:

a detection fluid container (13) for holding a pressurized detection fluid, the detection conduit (15) which is connected to the detection fluid container (13), wherein the detection conduit (15) comprises a detection hose (16) formed from a thermoplastic material, and a valve assembly (17) controlling a supply of detection fluid from the detection fluid container (13) to the detection conduit (15), characterized in that, the valve assembly (17) is configured to have:

i) an open operating state, in which the valve assembly (17) permits fluid communication between the detection fluid container (13) and the detection conduit (15), wherein the valve assembly (17) comprises a holding member being a plunger holding surface (41*a*) of a valve plunger (41) of the valve assembly (17) upon which a pressure force exerted by pressurized detection fluid in the detection conduit (15) acts to maintain the valve assembly (17) in the open operating position, and ii) a closed state, in which the valve assembly (17) prevents fluid communication between the detection fluid container (13) and the detection conduit (15), wherein the valve assembly (17) is arranged for switching from the open operating state to the closed state upon a reduction of the pressure force exerted on the holding member caused by said pressure drop in the detection conduit (15), such that outflow of detection fluid from the detection fluid container (13) is stopped.

2. Fire detection system according to claim 1, wherein the valve assembly (17) comprises a resilient member (45) which is arranged to exert a resilient force on the holding member, which resilient force co-operates with the pressure force to maintain the valve assembly (17) in the open operating state.

3. Fire detection system according to claim 2, wherein the resilient element is a spring (45).

4. Fire detection system according to claim 1, wherein the valve assembly (17) comprises a valve actuator member (43) for switching the valve assembly (17) from the closed state to the open operating state.

5. Fire detection system according to claim 1, wherein the valve assembly (17) further comprises a valve actuator member (43) and a resilient element (45) biased between the holding member and the valve actuator member (43), wherein the resilient element (45) acts to maintain the valve assembly (17) in the open operating state.

6. Fire detection system according to claim 1, wherein the valve assembly (17) comprises a restricted flow path through which the detection fluid container (13) communicates with the detection conduit (15) when the valve assembly (17) assumes the open operating state and which is blocked when the valve assembly (17) is switched to the closed state.

7. Fire detection system according to claim 6, wherein the valve plunger (41) of the valve assembly (17) comprises the restricted flow path.

8. Fire detection system according to claim 1, wherein the valve assembly (17) is further configured to have an intermediate filling state, in which the opening for fluid communication between the detection fluid container (13) and the detection conduit (15) is larger than it is in the open operating state.

9. Fire detection system according to claim 1, wherein a pressure indication device (37) is fluidly connected to the detection fluid conduit (15).

10. Fire detection system according to claim 1, wherein the detection fluid container (13) comprises a first chamber (29) for detection fluid and a second chamber (31) for drive gas, the first (29) and second (31) chambers being separated from each other by a piston (33) displaceably arranged in the detection fluid container (13) and sealed with regard to an inner wall (19) of the detection fluid container (13).

11. Method of controlling the fire detection system of claim 1, the method comprising:

switching, upon the reduction of the pressure force exerted on the holding member caused by said pressure drop in the detection conduit (15), from the open operating state to the closed state thereby stopping outflow of detection fluid from the detection fluid container (13).

12. Fire detection system according to claim 3, wherein the spring (45) is a compression spring.

13. Fire detection system according to claim 1, wherein the thermoplastic material is a thermoplastic fluoropolymer.

14. Fire detection system arranged for detecting fire by detecting a pressure drop in a detection conduit (15) caused by rupture of the detection conduit (15), the system comprising:

a detection fluid container (13) for holding a pressurized detection fluid, the detection conduit (15) which is connected to the detection fluid container (13), and a valve assembly (17) controlling a supply of detection fluid from the detection fluid container (13) to the detection conduit (15), characterized in that, the valve assembly (17) is configured to have:

i) an open operating state, in which the valve assembly (17) permits fluid communication between the detection fluid container (13) and the detection conduit (15), wherein the valve assembly (17) comprises a holding member being a plunger holding surface (41*a*) of a valve plunger (41) of the valve assembly (17) upon which a pressure force exerted by pressurized detection fluid in the detection conduit (15) acts to maintain the valve assembly (17) in the open operating position, wherein the valve assembly (17) comprises a resilient member (45) which is arranged to exert a resilient force on the holding member, which resilient force co-operates with the pressure force to maintain the valve assembly (17) in the open operating state, and ii) a closed state, in which the valve assembly (17) prevents fluid communication between the detection fluid container (13) and the detection conduit (15), wherein the valve assembly (17) is arranged for switching from the open operating state to the closed state upon a reduction of the pressure force exerted on the holding member caused by said pressure drop in the detection conduit (15), such that outflow of detection fluid from the detection fluid container (13) is stopped.

15. Fire detection system arranged for detecting fire by detecting a pressure drop in a detection conduit (15) caused by rupture of the detection conduit (15), the system comprising:

a detection fluid container (13) for holding a pressurized detection fluid, the detection conduit (15) which is connected to the detection fluid container (13), and a valve assembly (17) controlling a supply of detection fluid from the detection fluid container (13) to the detection conduit (15), characterized in that, the valve assembly (17) is configured to have:

i) an open operating state, in which the valve assembly (17) permits fluid communication between the detection fluid container (13) and the detection conduit (15), wherein the valve assembly (17) comprises a holding member being a plunger holding surface (41*a*) of a valve plunger (41) of the valve assembly (17) upon which a pressure force exerted by pressurized detection fluid in the detection conduit (15) acts to maintain the valve assembly (17) in the open operating position, ii) a closed state, in which the valve assembly (17) prevents fluid communication between the detection fluid container (13) and the detection conduit (15), and iii) an intermediate filling state, in which the opening for fluid communication between the detection fluid container (13) and the detection conduit (15) is larger than it is in the open operating state, wherein the valve assembly (17) is arranged for switching from the open operating state to the closed state upon a reduction of the pressure force exerted on the holding member caused by said pressure drop in the detection conduit (15), such that outflow of detection fluid from the detection fluid container (13) is stopped.

16. Fire detection system arranged for detecting fire by detecting a pressure drop in a detection conduit (15) caused by rupture of the detection conduit (15), the system comprising:

a detection fluid container (13) for holding a pressurized detection fluid, wherein the detection fluid container (13) comprises a first chamber (29) for detection fluid and a second chamber (31) for drive gas, the first (29) and second (31) chambers being separated from each other by a piston (33) displaceably arranged in the detection fluid container (13) and sealed with regard to an inner wall (19) of the detection fluid container (13), the detection conduit (15) which is connected to the detection fluid container (13), and a valve assembly (17) controlling a supply of detection fluid from the detection fluid container (13) to the detection conduit (15), characterized in that, the valve assembly (17) is configured to have:

i) an open operating state, in which the valve assembly (17) permits fluid communication between the detection fluid container (13) and the detection conduit (15), wherein the valve assembly (17) comprises a holding member being a plunger holding surface (41*a*) of a valve plunger (41) of the valve assembly (17) upon which a pressure force exerted by pressurized detection fluid in the detection conduit (15) acts to maintain the valve assembly (17) in the open operating position, and ii) a closed state, in which the valve assembly (17) prevents fluid communication between the detection fluid container (13) and the detection conduit (15), wherein the valve assembly (17) is arranged for switching from the open operating state to the closed state upon a reduction of the pressure force exerted on the holding member caused by said pressure drop in the detection conduit (15), such that outflow of detection fluid from the detection fluid container (13) is stopped.

* * * * *